US005427277A

United States Patent [19]

Bierend et al.

[11] Patent Number: 5,427,277

[45] Date of Patent: Jun. 27, 1995

[54] UTILITY-POWER OPERATED TAMPER-PROOF PRESSURIZED SPRAY CAN

[75] Inventors: Steven J. Bierend, Santa Maria; Clyde L. Tichenor, Fillmore; Irwin Ginsburgh, Newhall, all of Calif.

[73] Assignee: Electro Spray Co., Los Angeles, Calif.

[21] Appl. No.: 212,939

[22] Filed: Mar. 15, 1994

[51] Int. Cl.[6] ..... B67B 5/00

[52] U.S. Cl. ..... 222/153.09; 222/402.11; 222/504

[58] Field of Search ..... 222/504, 402.11, 402.13, 222/153, 333

[56] References Cited

U.S. PATENT DOCUMENTS

| | | | |
|---|---|---|---|
| 3,240,390 | 3/1966 | Mitchell et al. | 222/504 X |
| 3,294,290 | 12/1966 | Erickson et al. | 222/504 X |
| 3,351,240 | 11/1967 | Gray | 222/504 X |
| 3,627,176 | 12/1971 | Sailors | 222/504 X |
| 3,661,133 | 5/1972 | Rasch | 222/504 X |
| 3,666,144 | 5/1972 | Winder | 222/504 X |
| 3,974,941 | 8/1976 | Mettler | 222/504 X |
| 4,088,247 | 5/1978 | Hickman | 222/504 X |
| 5,318,197 | 6/1994 | Martindale et al. | 222/504 |

*Primary Examiner*—Andres Kashnikow
*Assistant Examiner*—Kenneth A. DeRosa
*Attorney, Agent, or Firm*—Albert O. Cota

[57] ABSTRACT

A utility-power operated, tamper-proof pressurized spray can (12) that can only be operated when connected to a-c utility power. Thus, its use to spray graffiti is prevented or at the very least minimized. The preferred embodiment of the invention consists of a spray can (12) having a housing opening (12B) to which is hermetically attached a solenoid housing (14). The housing (14), encloses a standard spray control valve (18) having in series, a linear-motion solenoid assembly (22) consisting of a stationary armature (24), a movable armature (28) and an external, separable movable-armature activator (40). The stationary armature (24) is rigidly attached to the housing (12), has a lower guide tube bore (24H) therethrough and an upward facing spring cavity (24G) which retains a spring (26). The movable armature (28) is located atop the stationary armature (24) and has an upper guide bores (24H,28C) is inserted a guide tube (32) which functions to deliver paint and as a positioning guide for the movable armature (28). The activator (40) includes an electromagnetic coil (42) that fits over the solenoid housing (14). When a-c power is not applied to the activator (40), the movable armature (28) remains in an upward position that prevents paint flow. When power is applied, the movable armature (28) moves to a downward position which allows paint to flow when a spray head (20) in the spray control valve (18), is depressed.

22 Claims, 6 Drawing Sheets

UTILITY-POWER OPERATED TAMPER-PROOF PRESSURIZED SPRAY CAN

TECHNICAL FIELD

The invention pertains to the general field of pressurized spray cans and more particularly to an aerosol paint spray can that can only be operated when it is connected by means of an a-c power cord, to an a-c utility power source.

BACKGROUND ART

The use of graffiti to deface various types of surfaces is wide spread both in cities of the United States of America and cities of many other industrialized world nations. Graffiti can consist of any unauthorized name, word or symbol or any combination thereof that is placed on a public or private surfaces by so called "graffiti taggers". Graffiti taggers have been around and have marked public surfaces since the days of the Pharaohs—even the pyramids did not escape this aesthetic plaque. Today, there is hardly a blank wall in inner cities, such as in central Los Angeles, that does not display some form of graffiti.

The primary target areas for graffiti taggers include public and private businesses, street and freeway signs, subways, trains and buses. To curtail the application of graffiti, several plans, devices and activities have been implemented: In Los Angeles, for instance, 4,000 people participated in a graffiti paint-out spearheaded by the Los Angeles Police Department. In one morning, the volunteers used 1700 gallons of paint and eradicated 62,000 feet of graffiti. The work of both public and private graffiti cleanup efforts are evident across the city in patchwork squares of unmatched paint on walls and buildings. As well meaning as cleanup techniques are, statistics have shown that when graffiti are covered in patches, the patches are invitations to graffiti vandals. Thus, graffiti is three times as likely to reappear then if the wall were all one color. To prevent street and particularly high-rise freeway signs from being marked razor wire has been placed around the signs access areas. The Transit Authorities of the various cities have taken cars out of service for cleaning as soon as they were marred by graffiti, no matter how slight the marking. Guards and dogs have also been posted in yards where these vehicles are stored for cleaning and maintenance.

To implement graffiti removal and watch programs has been costly for city governments. Most of the money goes to pay for crews that respond to the complaints by homeowners and businesses. Last year, the Los Angeles county government spent over $10 million trying to clean up the graffiti. The city of Los Angeles spent another $4 million, and the Southern California Rapid Transmit district spent $5 million. These figures are in addition to the money spent by various police agencies in chasing and arresting graffiti taggers. In New York, the Transit Authority has spent $6 billion in subway cleanup campaigns. Workers spend an average of 110 hours a week cleaning spray-paint off subway cars. In subways, it has been estimated that the national cost for controlling graffiti will exceed $4 billion. In addition to the cost involved in trying to eradicate graffiti, there is also the cost involved in decreased property values and in the more intangible psychic costs of living in a city that looks as though it is under siege.

Graffiti taggers use ballpoint pens, felt-tip markers and aerosol spray cans to perform their work with spray cans being the marker of choice. Over the years there have been various efforts to control graffiti by clamping down on the use of aerosol pain spray cans. According to the paint industry about 41,400 of these paint spray cans with a retail value of $120,000 are sold each day in Los Angeles, Orange, Riverside and San Bernardino Counties. By another estimate, more than 8,000 of these spray cans are used daily to deface property nationwide. To curtail the adverse use of spray cans, laws have been passed or are in process of passage to keep spray cans locked up, marking these cans unavailable for purchase by persons under the age of 18 and even to ban the sale of spray paint cans statewide, except those used by commercial firms. An outright ban is, of course, unfair to both the manufacturers and retailers—and most likely ineffective.

A search of the prior art did not disclose any patents or other literature that read directly on the claims of the instant invention. Particularly, no patents were found that disclosed aerosol paint spray cans that can only be operated when connected to a utility power source. However, the following U.S. patents were considered related:

| U.S. PAT. NO. | INVENTOR | ISSUED |
|---|---|---|
| 5,014,884 | Wonsch | 14 May 1991 |
| 4,972,975 | Fuhrig | 27 November 1990 |
| 4,971,257 | Birge | 20 November 1990 |

The Wonsch U.S. Pat. No. 5,014,884 discloses an aerosol spray can that includes a spray mechanism for finely atomizing fluids through a hydraulically-operated pump. The spray mechanism is inserted into a housing which is connected with the supply container for the liquid through a close-fitted or frictional locking connection. The spray mechanism incorporates a battery operated gear pump in which, the suction line of the pump is connected through an opening in the bottom of the housing into the supply container. The supply container is equipped with a venting line, whereby the gear pump includes a pressure tube at its output which is connected with a discharge nozzle.

The Fuhrig U.S. Pat. No. 4,972,975 discloses a housing that stores a battery that powers an electric motor that operates a compressor for producing compressed air in combination with a suction unit and a pressure joint. A product container that includes a spray nozzle is placed inside the housing with a connection between the pressure joint of the compressor and the interior of the product container. The compressor pressurizes the product container through an aperture thereby forcing the liquid through the container spray nozzle.

The Birge U.S. Pat. No. 4,971,257 discloses an electrostatic particle spraying apparatus. The apparatus includes a hand held triggering mechanism that includes a d-c power source and a coupling sleeve into which a conventional aerosol spray can is inserted when the triggering mechanism is squeezed, a hammer depresses the nozzle tip of the aerosol can, releasing the pressurized fluid of the can from the nozzle tip.

This application is also related to the applicant's copending application Ser. No. 08/095,851, filed Jul. 23, 1993 and entitled Utility-Power Operated Aerosol Spray Can.

For background purposes and indicative of the art to which the invention relates, reference may be made to the following remaining patents found in the pre-examination search:

| PATENT NO. | INVENTOR | ISSUED |
|---|---|---|
| 5,069,391 | Seasholtz | 3 December 1991 |
| 4,618,099 | Nagad et al | 21 October 1986 |

DISCLOSURE OF THE INVENTION

The utility-power operated, tamper-proof pressurized spray can is designed to operate only if an energizer connected to the can is connected by means of a power cord, to a utility a-c power receptacle. Therefore, "graffiti taggers" are prevented from using spray cans in areas not having access to an a-c power source. Thus, the use of spray cans to spray graffiti is greatly reduced or eliminated. In its basic design configuration, the utility-power operated, tamper-proof, pressurized spray can consists of:

A. a pressurized spray can consisting of an upper section having a solenoid housing opening and a paint siphon tube uprightly located therein, B. a solenoid housing having a top section and an open bottom section having a perimeter edge. The top section includes a spray head stem opening and the open bottom section is attached to the solenoid housing opening on the spray can by an attachment means, C. a standard spray control valve having a paint passage channel, an upper end and a lower end. The lower end is attached to and is within the housing, by an attachment means, and its upper end interfaces with the spray head stem opening on the housing, D. a separable spray head having an upper surface and a downward, hollow stem that is inserted through the spray head stem opening and into the upper end of the standard spray control valve, E. a linear-motion solenoid assembly comprising:

a) a stationary armature positioned and rigidly attached within the housing, by an attachment means. The stationary armature has:

(1) a bottom surface and a top surface, with its bottom surface located near the perimeter edge of the housing, (2) a spring cavity extending downward from the top surface into which is inserted a spring and, (3) a lower guide tube bore that extends through said stationary armature, b) a movable armature located above the stationary armature and having:

(1) a top surface, a bottom surface, and a diameter that allows the movable armature to traverse longitudinally through the solenoid housing, and, (2) an upper guide tube bore therethrough having a slightly larger diameter than that of the lower guide tube bore, c) a non-magnetic paint guide tube having a lower section that is press-fitted into the lower guide tube bore on the stationary armature. The end of the tube's lower section is inserted into the paint siphon tube located within said spray can. The upper section of the tube, projects upward from the stationary armature and into the slightly larger diameter upper guide tube bore on the movable armature. The tube functions as a paint channel as a positioning guide for the movable armature, d) an external, separable movable-armature activator that is comprised of an electromagnetic coil sized to fit over the solenoid housing. When the assembly is not connected to an a-c utility power receptacle, the paint pressure in the can and the spring, located in the stationary armature, maintains the movable armature in the de-energized, upward position. In this position, the upper surface of the movable armature presses against the lower end of the spray control valve and functions as a series valve that is in a closed position. Thus, preventing the spray control valve from receiving paint and preventing the spray head from dispensing paint. Conversely, when the linear-motion solenoid assembly is connected to the a-c utility power, the movable armature overcomes the paint pressure and spring bias and moves to the energized, downward position. In this position, paint is allowed to flow through the paint guide tube onto the spray control valve. The spray control valve can then be opened by manually depressing the spray head. When the spray head is held in one depressed position, the pressurized paint flows through the paint guide tube and out of the spray head.

The solenoid housing is preferably made of a non-magnetic material and includes an upper protuberance that accepts and houses the upper end of the spray control valve. The lower end of this valve is held and attached within a valve retaining cavity recessed onto a spray control valve retaining structure. The structure is located under the upper protuberance and has a substantially centered paint passage bore therethrough.

The linear-motion solenoid assembly is located in series with the spray control valve with the upper guide tube bore projecting through the top surface of the movable armature in alignment with the paint passage bore on the valve retaining structure. Between the lower surface of the valve retaining structure and the top surface of the movable armature is a space that has therein a paint passage sealing means. Preferably this sealing means consists of a combination o-ring, and a loosely coupled, non-magnetic, L-shaped valve leaf that is attached to the side of the movable armature. When the movable armature is in the de-energized position, the valve leaf presses against the o-ring to seal the paint passage. To open the paint passage, the external, separable, movable-armature activator that is attached to an a-c power receptacle is placed over the solenoid housing to release the valve leaf from the o-ring and allow paint to be sprayed when the spray head is depressed.

The preferred embodiment of the invention is as described above. However, a secondary design is also disclosed that allows an unmodified aerosol spray paint can to include the addition of the invention. In this retrofit design, the solenoid housing has an attachment seam that is sized and configured to be attached to an attachment ring located on the standard spray can. The paint guide tube within the solenoid housing is necked down at its lower end and inserted into the spray head insertion opening located on the upper section of the spray can. The remainder of the design and function is identical to that of the preferred embodiment.

In view of the above disclosure, it is the primary object of the invention to provide an aerosol spray can that can only be operated when the can is connected to an a-c utility power source. Because of the a-c power requirement, the average spray paint graffiti tagger will be unable to spray graffiti in most outdoor locations. In addition to the primary object of the invention, it is also an object of the invention to provide an aerosol spray can that:

- is designed so that if a graffiti tagger attempts to connect a magnet or a d-c battery to the solenoid housing, the linear-motion solenoid assembly will not function and paint cannot be sprayed,
- if a tagger attempts to puncture the solenoid housing, the puncture will quickly depressurize the an and create an uncontrolled paint flow at the puncture opening,
- is reliable and maintenance free,
- is cost effective from both a manufacturers and consumers point of view, and
- will save countless manhours and costs expended in the removal of graffiti from various structures.

These and other objects and advantages of the present invention will become apparent form the subsequent detailed description of the preferred embodiment and the appended claims taken in conjunction with the accompanying drawings.

BEST MODE FOR CARRYING OUT THE INVENTION

Figure 1:
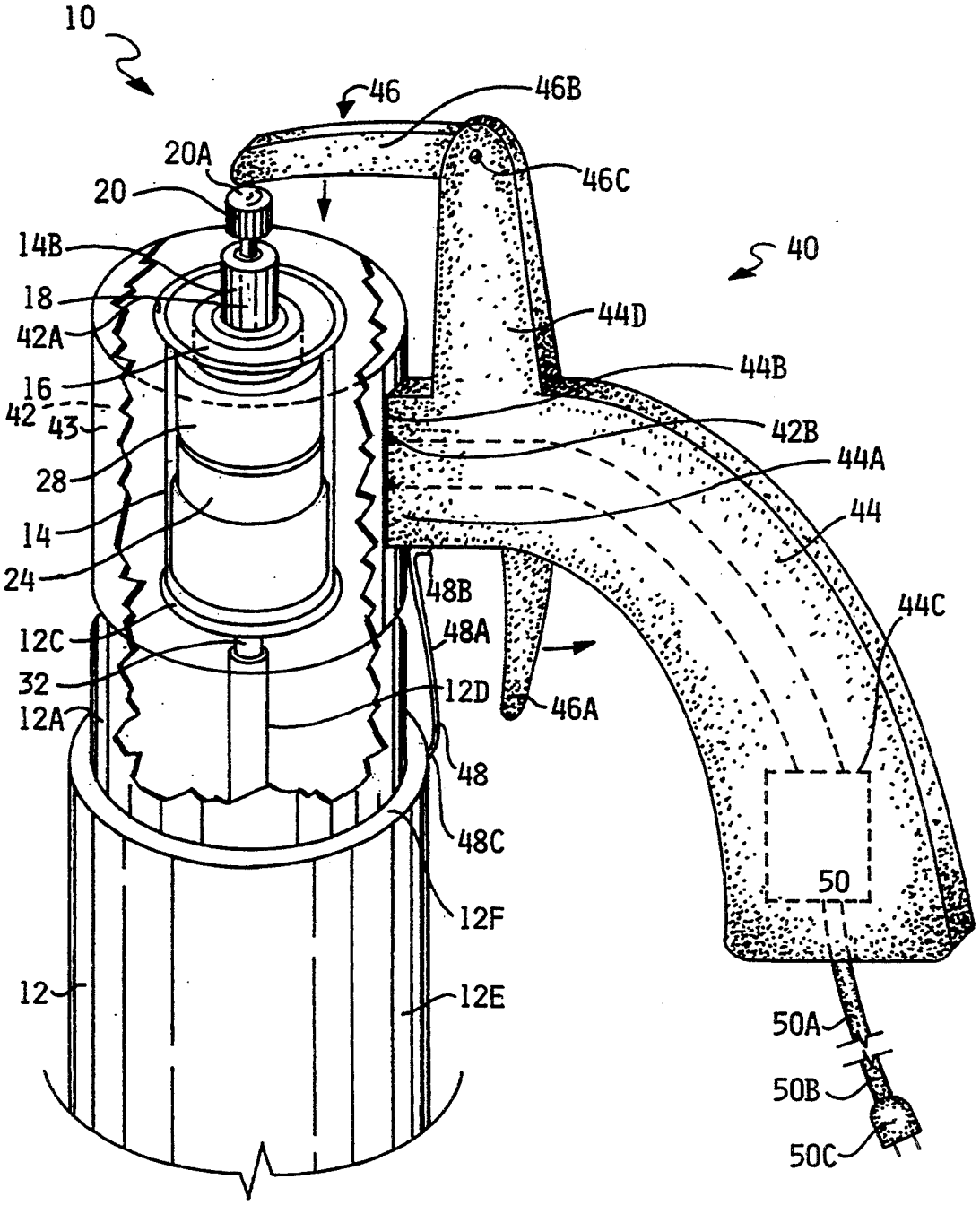
FIG. 1 is a perspective view of the preferred embodiment of the utility-power operated tamper-proof pressurized spray can.

The best mode for carrying out the invention is presented in terms of a preferred embodiment and a second embodiment. The preferred embodiment utilizes a spray can having a specially designed upper section while in the second embodiment an unmodified spray can can be used. In either embodiment, it is the purpose of the invention to produce a spray can that can only be operated when a-c utility power is applied to an energizer attached to the can. Thus, its use for spraying graffiti is eliminated or significantly curtailed.

The preferred embodiment of the utility-power operated, tamper-proof pressurized spray can 10 is presented in FIGS. 1–10 and is comprised of the following major elements: a pressurized spray can 12; a solenoid housing 14; a spray control valve retaining structure 16; a spray control valve 18; a separable spray head 20; a linear-motion solenoid assembly 22 consisting of a stationary armature 24, a spring 26 and a movable armature 28; a valve leaf 30; a paint guide tube 32; and an external, separable movable-armature activator 40.

Figure 2:
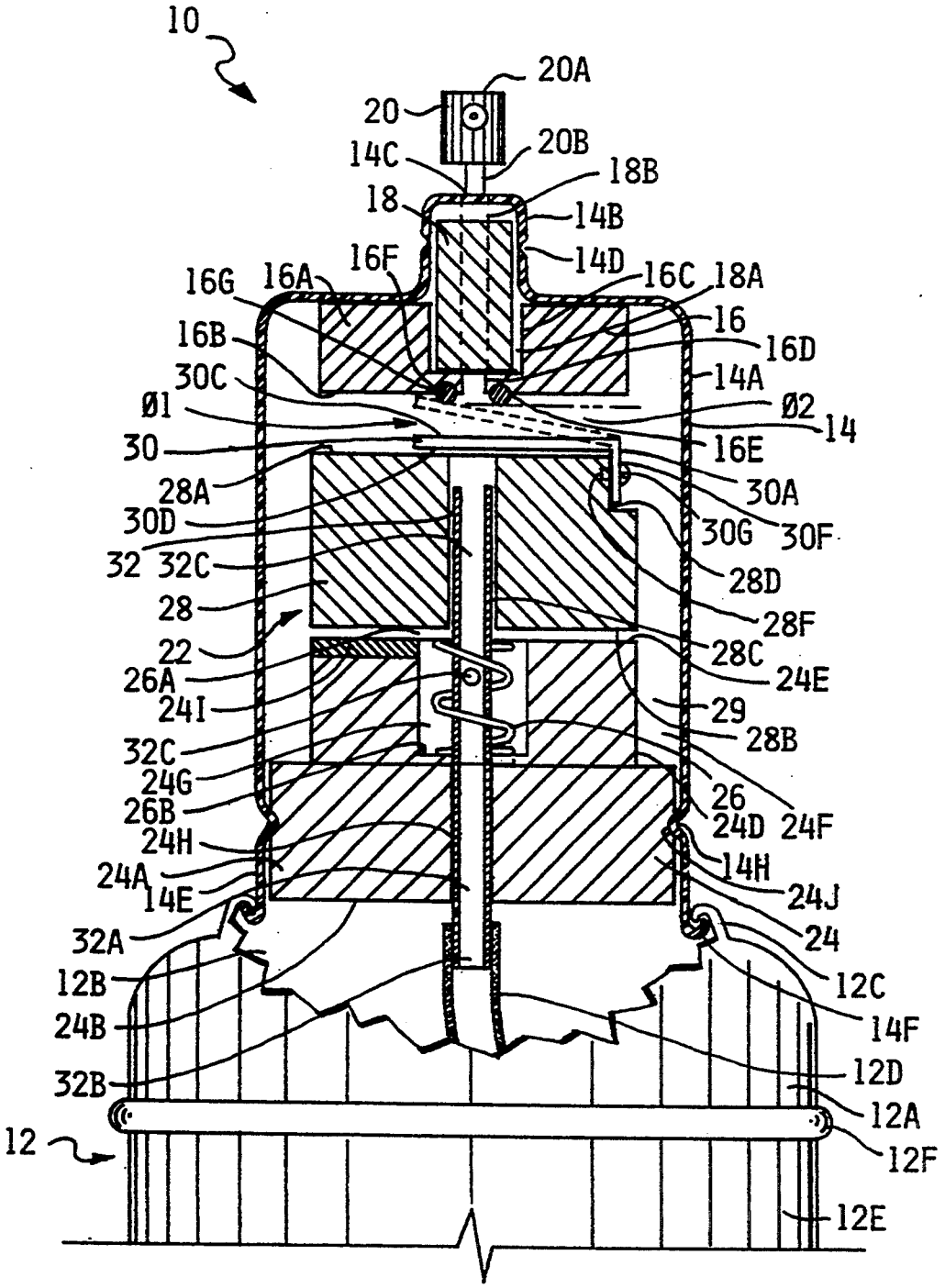
FIG. 2 is an elevational, sectional view of the utility-power operated tamper-proof pressurized spray can showing the relative placement of the principle elements of the invention.

The pressurized spray can 12 used in the preferred emboidmetn consists of an upper section 12A and a lower section 12E as shown in FIGS. 1 and 2. The upper section 12A has a housing opening 12B as shown in FIG. 2, that includes around its circumferential perimeter, a first attachment seam 12C. The lower section 12E attaches to the upper section 12A by means of an attachment ring 12F. The final element that comprises the can 12 is a liquid siphon tube 12D that is uprightly located therein as shown in FIG. 2, and from where paint is siphoned from the bottom of the can 12.

The solenoid housing 14 which is preferably constructed of a non-magnetic material, consists of a top section 14A and an open bottom section 14E. The top section as best shown in FIG. 2, includes an integral upper protuberance 14B that has at its top end a spray head stem opening 14C. The open bottom section 14E of the housing has at its perimeter edge, a second attachment seam 14F, that is designed to interface with and lock to the first attachment seam 12C on the spray can 12.

The spray control valve retaining structure 16 as shown in FIG. 2, includes an upper surface 16A, a lower surface 16B and, a valve retaining cavity 16C. The cavity is recessed into the upper surface 16A and is centrally located under the protuberance 14B on the housing 14. The cavity 16C also includes a substantially centered paint passage bore 16D extending from the bottom of the cavity recess to the bottom of the spray control valve retaining structure 16. Within the upper protuberance 14B and into the cavity 16C is located a standard spray control valve 18.

The spray control valve, as also best shown in FIG. 2, is inserted into the valve retaining cavity 16C and attached therein by an attachment means 18A that preferably consists of an adhesive. The valve 18 is also held within the protuberance 14B by a valve crimp 14D as also shown in FIG. 2. The valve 18 includes a paint passage channel 18B that interfaces with the paint passage bore 16D on the valve retaining structure 16 and is designed to operate with a separable spray head 20. This spray head has an upper surface 20A and a downward, hollow stem 20B that is inserted into the paint passage channel 18B on the standard spray control valve 18, when the spray head is depressed, the valve opens.

Located on the lower surface 16B of the valve retaining structure 16, around the paint passage bore 16D, is a paint passage sealing means 16E that functions in combination with a valve leaf 30 that is described infra. The two elements provide a combination valve that is located in series with the standard spray control valve 18. The paint passage sealing means 16E is disclosed in three designs.

Figure 6:
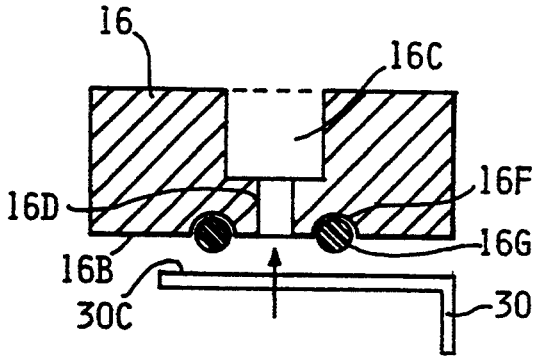
FIG. 6 is an elevational, sectional view showing a first design of a paint sealing means consisting of an o-ring and a valve leaf.

The first design as shown in FIG. 6, comprises an o-ring channel 16F that is centrally located on the lower surface 16B of the valve retaining structure 16 around the paint passage bore 16D. Into the o-ring channel 16F is partially inserted a resilient o-ring 16G that is attached therein by an attachment means that preferably consists of an adhesive. When the movable armature 28 is in its de-energized, upward position, the o-ring 16G functions to seal against the valve leaf 30 and seal the paint passage bore 16D. Thus, preventing paint flow through the spray control valve 18.

Figure 7:
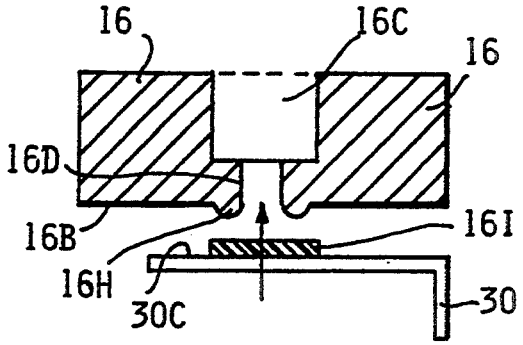
FIG. 7 is an elevational, sectional view showing a second design of a paint sealing means consisting of a high-unit pressure ring and a compliant pad that is attached to the valve leaf.
Figure 8:
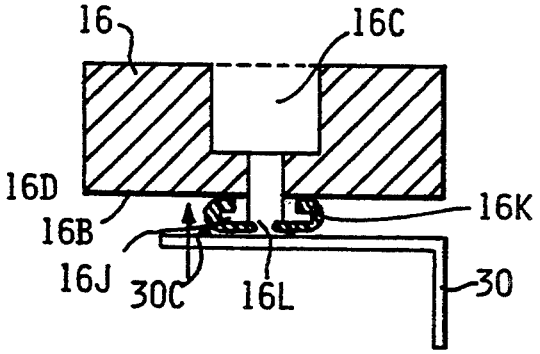
FIG. 8 is an elevational, sectional view showing a third design of a paint sealing means consisting of a an expanded bore lip attached around the perimeter of the paint passage bore and a compliant ring that is attached to the valve leaf.

The second designs as shown in FIG. 7, comprises a a downward extending lip 16H and a compliant pad 16I. The lip 16H is centrally fixed to the lower surface 16B of the valve retaining structure 16 around the paint passage bore 16D and the compliant pad 16I attached to the upper surface of the valve leaf 30. When the movable armature 28 is placed in its de-energized, upward position, the lip 16H contacts the compliant pad 16I to seal and prevent paint flow through the spray control valve 18.

The third and final design disclosed for the paint passage sealing means 16E is comprised of an expanded bore lip 16J that is attached around the perimeter of the paint passage bore 16D. Around the lip 16J is mounted and held a stretchable compliant ring 16K having a paint passage bore 16L and that functions as an o-ring. When the movable armature 28 is placed in its de-energized, upward position, the compliant ring 16K makes contact with the upper surface 30C of the valve leaf to seal the paint passage bore 16D. Thus, preventing paint flow through the spray control valve 18.

Below and in series with the spray control valve 18 and the paint passage sealing means 16E is the linear-motion solenoid assembly 22 which consists of a stationary armature 24, a spring 26 and a movable armature 28.

The stationary armature 24 has a lower section 24A having a bottom surface 24B and a diameter, that allows the stationary armature 24 to tightly fit into the solenoid housing 14. When so fitted, the bottom surface 24B is positioned near the lower perimeter edge of the housing as best shown in FIG. 2.

The stationary armature 24 is attached to the solenoid housing 14 by an attachment means 14G,24C. Preferably, this attachment means consists of a male crimp ring 14H and a female crimp ring 24J. As shown in FIG. 2, the male crimp ring 14H is located around the perimeter of the solenoid housing 14 above the second attachment seam 14F. The female crimp ring 24J is located around the perimeter of the stationary armature 24 in alignment with the male crimping 14H. When the stationary armature 24 is inserted into the open bottom section 14E of the housing 14 and the pair of crimp rings 14H,24J interface, the stationary armature 24 is rigidly attached.

The stationary armature 24 also includes an integral upper section 24D having a top surface 24E and a smaller diameter than that of the lower section 24A. The smaller diameter allows a space 24F to exist between the upper section 24D and the solenoid housing 14. Extending downward from the top surface 24E of the upper section 24D is a substantially centered spring cavity 24G into which is inserted a spring 26. Through the bottom of the spring cavity 24G and through the lower section 24A of the stationary armature 24 is a lower guide tube bore 24H. Also, extending horizontally across the top surface 24E of the stationary armature 24 from one side of the spring cavity 24G to the edge of said stationary armature 24, is a paint flow channel 24I.

The second element of the linear-motion solenoid assembly 22 is the movable armature 28. The movable armature has a top surface 28A, a bottom surface 28B and a diameter that is substantially equal to the smaller diameter of the upper section 24D of the stationary armature 24. The smaller diameter of the upper section 24D of the stationary armature 24 and the like diameter of the movable armature 28 creates a space 29 between the surface of the two armatures and the inside wall of the housing 14 as shown in FIG. 2. This space precludes an individual from trying to energize the assembly 22 by holding a permanent magnet (not shown) against the surface of the solenoid housing 14. Through the armature 28 is located an upper guide tube bore 28C that has a slightly larger diameter than that of the lower guide tube bore 24H on the stationary armature 24.

Figure 3:
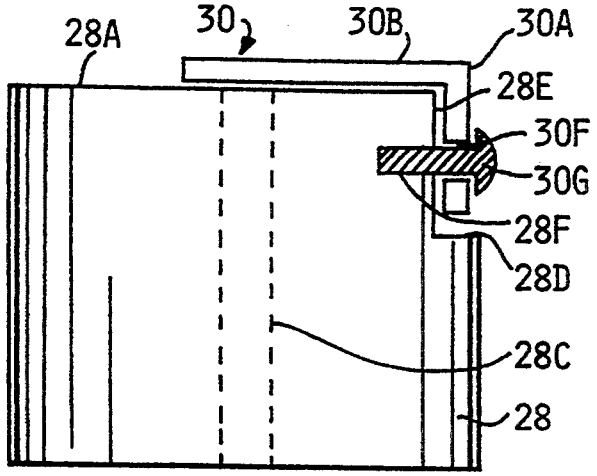
FIG. 3 is an elevational view of the movable armature with the valve leaf attached.

Located in chord relationship on one side of the movable armature 28 is a valve leaf attachment step 28D having a vertical side 28E to which is attached, as shown in FIG. 3, the non-magnetic valve leaf 30. The valve leaf is configured in an L-shape with a vertical section 30A and a horizontal section 30B. The vertical section 30A is loosely coupled, by an attachment means, to the vertical side 28E of the attachment step 28D. The attachment means preferably consists, as shown in FIG. 3 of a leaf pin bore 30F located through the vertical section 30A of the valve leaf 30. A slightly smaller step pin bore 28F is located on the vertical side 28E of the valve leaf attachment step 28D. A spiraled pin or a press-fit pin 30G is then loosely inserted through the leaf pin bore 30F and tightly into the step pin bore 28F to loosely couple the valve leaf 30 to the valve leaf attachment step 28D.

The horizontal section 30B of the valve leaf 30 as shown in FIG. 2, is movably positioned in either an open position $\phi 1$ or a closed position $\phi 2$ (shown in dashed lines) between the valve sealing means on the lower surface 16B of the valve retaining structure and the top surface 28A of the movable armature. The movable armature 28 is designed to be maintained in a normal, de-energized, upward position by the spring 26 and the paint pressure. In this normal position, the top surface 28A of the movable armature 28 makes contact with the valve leaf 30, placing the valve leaf in its closed position $\phi 2$. When the movable armature 28 is placed in its energized, downward position by the activator 40 as described infra, the bottom surface 28B of the movable armature 28 makes contact with the top surface 24E of the stationary armature 24. This action, causes the leaf spring 30 to move to its open position $\phi 1$ as shown in FIG. 2, which then allows paint to flow through the paint passage bore 16D and paint passage channel 18B.

The valve leaf 30 is designed to function as a first class lever in relation to the o-ring 16G or the other disclosed designs of the paint passage sealing means 16E. This lever provides both a force multiplier and a "break seal" function. Hydraulic theory dictates that when the valve leaf 30 seals against the fluid flow on the o-ring 16G, there is a hydraulic pressure exerted on the valve leaf 30 which corresponds to the internal pressure of the spray can which ranges between 70–80 psi. This pressure normally exceeds the electromagnetic force produced by the electromagnetic coil 42 of the external, separable movable-armature activator described infra. However, in the instant invention, the valve leaf 30 is loosely coupled to the movable armature 28 as shown in FIGS. 2 and 3. Therefore, when the movable armature 28 is placed in its energized, downward position, a first class lever condition is created using the drive energy of the press-fit pin 30G of the valve leaf attachment means against the opposite side of the o-ring 160. This leverage ratio breaks the seal condition on the opposite side of the o-ring 16G and releases the hydraulic pressure. Thus, causing the valve leaf 30 to move to its open $\phi 1$ position.

Figure 9:
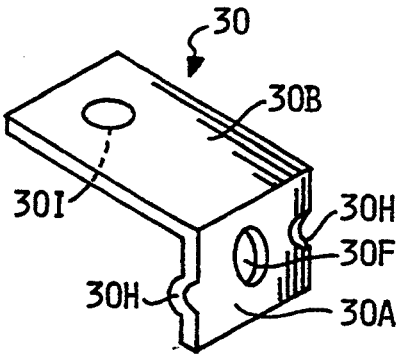
FIG. 9 is a perspective view of the valve leaf showing the locations of a dimple and a pair of pivot indentations.
Figure 10:
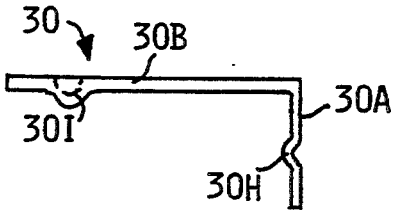
FIG. 10 is a side elevational view of the valve leaf showing the location of the dimple and the pair of pivot indentations.

To further enhance the utility of the valve leaf 30 it may be designed to include a pair of pivot indentations 30H as shown in FIGS. 9 and 10. These indentations are aligned horizontally with respect to the center of the leaf pin bore 30F and extend inward from each side of the leaf's vertical section 30A. The pivots 30H facilitate the pivoting action of the valve leaf 30 from an energized position to a de-energized position and vice versa while limiting sideward movement. The indentations also allow the precise alignment of the valve leaf and the paint passage sealing means.

The valve leaf may further include a dimple 30I, as also shown in FIGS. 9 and 10, that extends downward from its lower surface 30D and that is concentrically aligned with the paint passage bore. The dimple provides a means for allowing tiltable alignment of the valve leaf 30 with the paint passage sealing means.

The paint flow is accomplished through the non-magnetic paint guide tube 32 which includes a lower section 32A and an upper section 32D.

The lower section 32A is press-fitted into the lower guide tube bore 24H on the stationary armature 24. The lower section 32A also has a lower end 32B that projects through the bottom surface of the stationary armature as shown in FIG. 2 and is inserted into the siphon tube 12D located within the spray can 12. The lower section 32A further has within a distance confined by the length of the spring cavity 24G, the paint passage opening 32C. This opening, allows a secondary paint flow to exit and flow through the paint flow channel 24I on the stationary armature 24. The upper section 32D projects upward from the top surface 24E of the stationary armature 24 and into the slightly larger diameter upper guide tube bore 28C on the movable armature 28. In addition to functioning as a paint flow means, the paint guide tube 32 also functions as a guide for the movable armature 28.

The fourth and final element that comprises the linear-motion solenoid assembly 22 and which is the key to operate the assembly 22 is the external, separable, movable-armature activator 40 as shown in FIG. 1. This assembly is comprised of an electromagnetic coil 42, an outer coil casing 43, a handle 44, a trigger structure 46 and an electronic power circuit 50.

Figure 4:
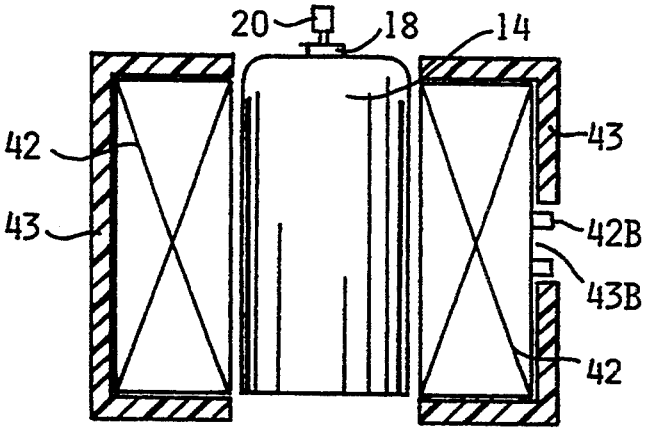
FIG. 4 is an elevational view showing the electromagnetic coil casing as placed around the electromagnetic coil.

The electromagnetic coil is designed with a center attachment opening 42A that is sized to snugly fit over the diameter of the solenoid housing 14; a length that substantially encloses the length of the housing 14 and pair of coil pint terminals 42B as shown in FIG. 4.

The non-magnetic, outer coil casing 43 that encloses the coil as shown in FIGS. 1 and 4, is attached thereto by an attachment means. The casing has an opening 43B that is positioned to allow the pair of coil input terminals 42B to project therethrough. The handle 44 has a forward section 44A that attaches, by an attachment means, to the outer coil casing 43. Included within the handle is a power circuit housing 44C and a trigger pivot housing 44D. The housing 44D houses a trigger structure 46 that includes a lower mechanical finger trigger 46A and an upper head spray lever 46B that pivots about a trigger pivot 46C and that interfaces with the upper surface 20A of the spray head 20.

The movable-armature activator 40 is releasably attached to the paint spray can 12 by an attachment means 48. One implementation of this attachment means consists of having at least one spring latch 48A having an upper end 458B that is rigidly attached to the bottom of the forward section of the handle 44 and a lower end 48C having a gripping hook 48D that attaches to the attachment ring 12F on the spray can 12.

Figure 5:
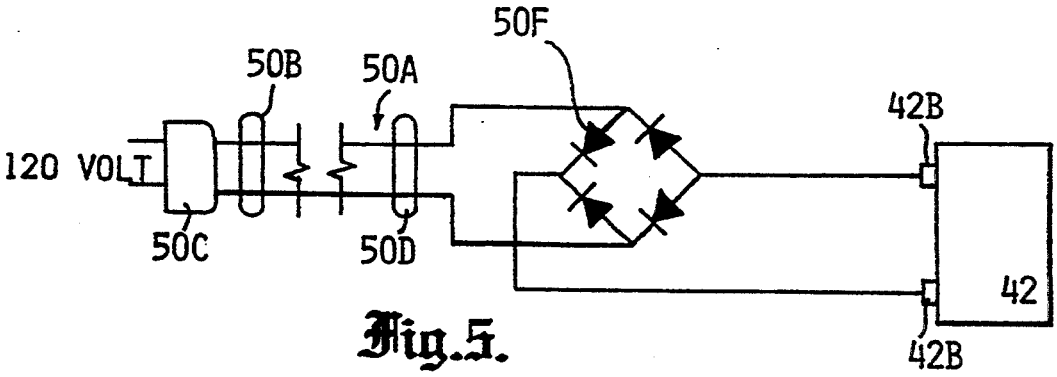
FIG. 5 is a schematic diagram of the electronic power circuit.

The electronic power circuit 50 as shown schematically in FIG. 5, is located within the power circuit housing 44C in the handle 44 as shown in FIG. 1. The circuit is comprised of an a-c power cord 50A having a first end 50B that has attached an a-c power connector 50C that connects to a utility power receptacle and a second end 50D that is attached to the input of a full-wave rectifier 50F. The output of the full-wave rectifier is a pulsating d-c current that is applied to the coil 42 via the input terminals 42B of the electromagnetic coil 42. The use of the a-c utility power precludes the use of low-voltage batteries to operate the solenoid assembly 22.

When the linear-motion solenoid assembly 22 is not energized by the movable-armature activator 40, the paint pressure and the spring 26, located in said stationary armature, maintain the movable armature 28 in the de-energized, upward position. In the upward position, the valve leaf 30 and the paint passage sealing means function in combination as a closed valve that is in series with the spray control valve 18. The closed combination valve prevents the spray control valve 18 from receiving paint and prevents the spray head 20 from dispensing paint. Conversely, when the movable-armature activator 40 is connected to an a-c power receptacle, a d-c current is produced by said full-wave rectifier 50F. This current energizes the electromagnetic coil 42 which then causes the movable armature 28 to overcome the paint pressure and spring bias and move to the energized, downward position. In the downward position the combination valve opens to allow the spray control valve 18 to be activated when the spray head 20 is depressed. This action allows pressurized paint to flow through said paint passage bore and out of the spray head 20.

The second embodiment of the utility-power operated, tamper-proof pressurized spray can 10 allows the invention to be attached to a standard unmodified pressurized spray can 12. This design differs in structure only from the preferred embodiment in the configuration of the solenoid housing 12 and the paint guide tube 32.

Figure 11:
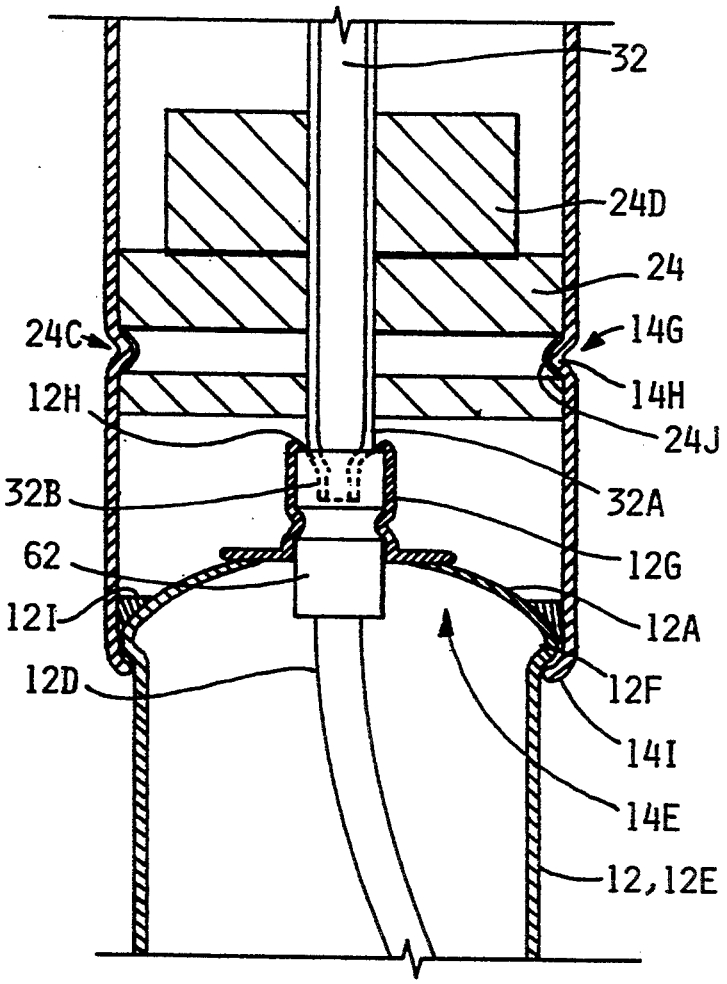
FIG. 11 is a partial, elevational, sectional view of the second embodiment of the utility-power operated, tamper-proof pressurized spray can.

As shown in FIG. 11, the standard pressurized spray can 12 includes an upper section 12A having a protuberance 12G that has a spray head insertion opening 12H. The opening 12H interfaces with the upper end of a conventional spray control valve 62 located within the protuberance 12G. The valve has a lower end that normally attaches to the upper end of a paint siphon tube 12D uprightly located therein. The upper section 12A of the can is attached to the can's lower section 12E by an attachment ring 12F.

The solenoid housing 14, which is preferably made of a non-magnetic material differs form the preferred embodiment in the configuration of its open bottom section 14E. This section has at its perimeter edge, an attachment seam 14I that is sized to forceably interface with the attachment ring 12F on the spray can 12. To further attach the housing 14 to the spray can 12, a heat flow adhesive ring 12I may be paced around the interface joint.

The third and final differing element used in the second embodiment is the non-magnetic paint guide tube 32. This tube differs in that its lower section 32A has a lower end 32B that is necked-down to a size that can be inserted into the spray-head insertion opening 12H on the spray can as shown in FIG. 11. The remainder of the elements used in the second embodiment are identical to those of the preferred embodiment and perform similar functions.

Figure 12:
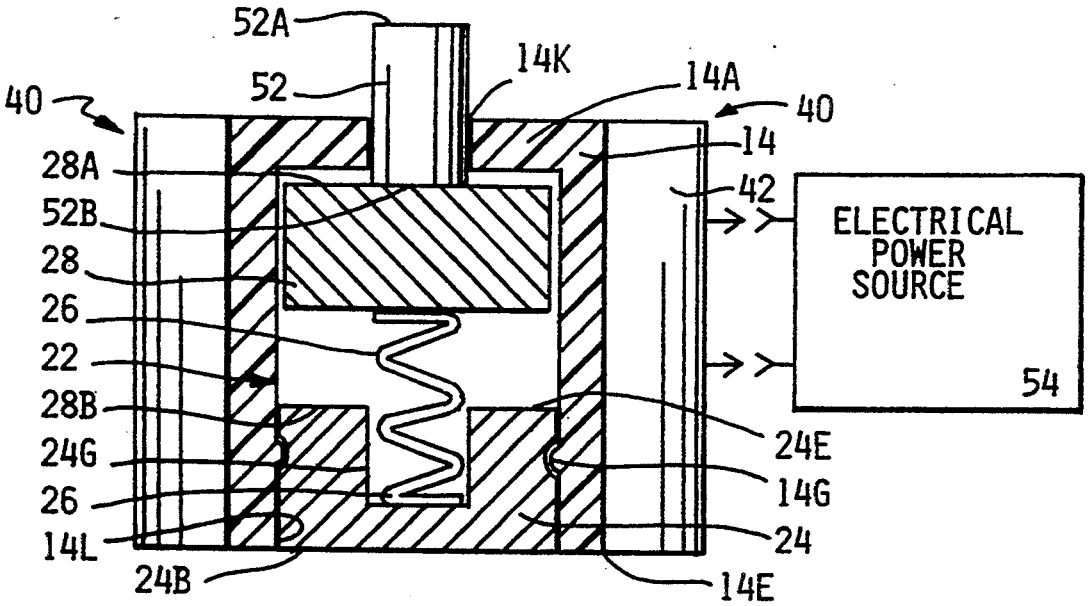
FIG. 12 is an elevational, sectional view of a simplified design of the invention showing the movable armature in the de-energized position.
Figure 13:
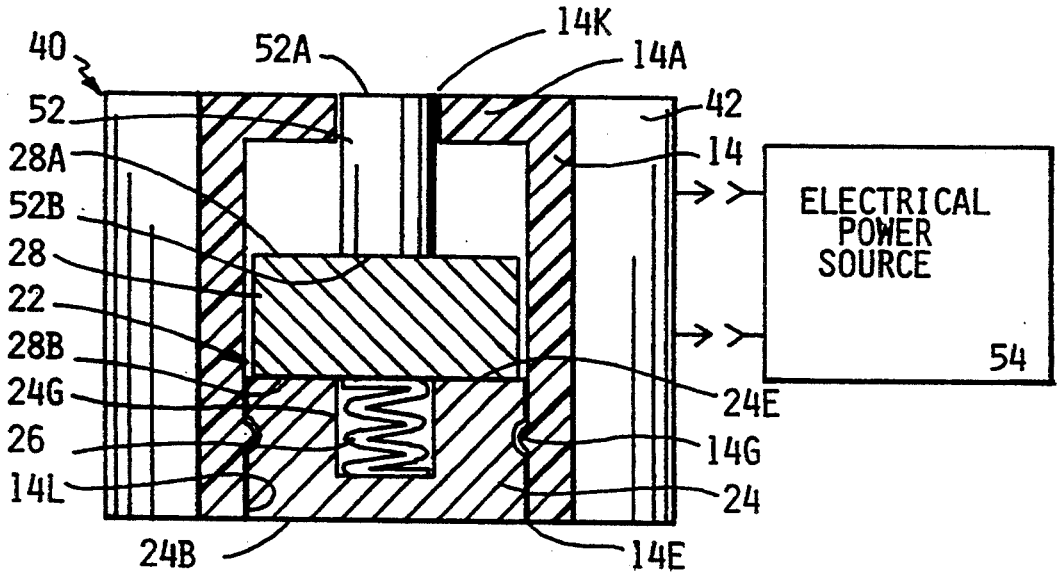
FIG. 13 is a an elevational, sectional view of a simplified design of the invention showing the movable armature in the energized position.

The primary element that allows the utility-power operated tamper-proof pressurized spray can to be implemented for use as a graffiti deterrent is the electrically energized, linear-motion solenoid assembly 22. This assembly has applicability for uses other than for implementation in a pressurized spray can. Therefore, it is disclosed below in a simplified design configuration as could be used to function, for example, as a locking device. In this basic design, the assembly 22 as shown in FIGS. 12 and 13, consists of a non-magnetic solenoid housing 14 having a top section 14A that includes a power rod bore 14K and an open bottom section 14E having a perimeter edge 14L. Within the housing is located a linear-motion solenoid assembly 22. This assembly in its simplified design, consists of a stationary armature 24 and a movable armature 28. The stationary armature 24 is positioned and rigidly attached within the housing 14, by an attachment means 14G. The stationary armature includes a bottom surface 24B and a top surface 24E. The bottom surface 24B is located near the perimeter edge 14L of the housing 14. Extending downward from the top surface 24E of the stationary armature is a spring cavity 24G into which is inserted a spring 26.

The movable armature 28 is located above the stationary armature 24 and includes a top surface 28A, a bottom surface 28B and a diameter that allows the movable armature 28 to traverse longitudinally through the solenoid housing 14. Projecting through the power rod bore 14K in the housing 14 is a power rod 52 having an upper end 52A and a lower end 52B. The lower end is rigidly positioned and attached to the top surface 28A of the movable armature 28. Thus, its upper end 52A can traversely move in and out of the power rod bore 14K on the housing 14.

The linear-motion solenoid assembly 22 is operated by means of an external, separable movable-armature activator 40. The activator 40 is comprised of an electromagnetic coil 42 that is sized to fit over the solenoid housing 14. When the activator 40 is not connected to an electrical power source 54, the spring 26 located in the stationary armature 24, maintains the movable armature 28 in the de-energized, upward position. When in the upward position, the power rod 52 protrudes through the power rod bore 14K on the housing as shown in FIG. 12. Conversely, when the linear-motion solenoid assembly 22 is connected to the power source 54, the movable armature 52 overcomes the spring bias and moves to the energized, downward position as shown in FIG. 13. When in the downward position, the power rod 52 is retracted so that its upper end 52A is substantially flush with the top section 14A of the housing 14.

As described above, the assembly 22 could be used to lock a structure when the power rod 52 is in the de-energized, upward position as in FIG. 13 When the structure is to be unlocked, the separable activator 40 is connected to the power source 54 and placed over the housing 14. This action causes the power rod 52 to retract as in FIG. 13 and unlock the structure.

While the invention as been described in complete detail and pictorially shown in the accompanying drawings, it is not to be limited to such details, since many changes and modifications may be made in the invention without departing form the spirit and scope thereof. For example, in lieu of a handle 44, the coil terminals 423B can be connected directly to an a-c power cord 50A. In this design, a user would place the hand around the casing 43 and conventionally depress the spray head 20 with the thumb. Hence, it is described to cover any and all modifications and forms which may come within the language and scope of the appended claims.

We claim:

1. A directly hand-held, utility-power operated pressurized spray can, comprising:
   - A) a pressure spray can comprising:
     - a) an upper section having:
       - (1) a spray head stem opening,
       - (2) a spray control valve having a paint passage channel that terminates at the spray head stem opening,
     - b) a lower section having a connecting paint passage opening that interfaces with a lower magnetically operated series valve and the paint passage channel of said spray control valve,
   - B) a separable spray head
   - C) an a-c powered, separable energized that magnetically activates said lower magnetically operated series valve and
   - D) a connecting means from said energizer to an a-c utility power receptacle.

2. A utility-power operated, pressurized spray can comprising:
   - A. a pressurized spray can comprising:
     - a) an upper section having a solenoid housing opening,
     - b) a siphon tube uprightly located therein,
   - B. a solenoid housing having:
     - a) a top section that includes a spray head stem opening,
     - b) an open bottom section having a perimeter edge that attaches to the solenoid housing opening on said spray can by an attachment means,
   - C. a spray control valve having a paint passage channel, an upper end, a lower end and that is attached within said housing, by an attachment means, with its upper end interfacing with the spray head stem opening,
   - D. a separable spray head having an upper surface and a downward, hollow stem that is inserted into the upper end of said spray control valve,
   - E. a linear-motion solenoid assembly comprising:

a) a stationary armature positioned and rigidly attached within said housing, by an attachment means, and having:
(1) a bottom surface and a top surface, with its bottom surface located near the perimeter edge of said housing,
(2) a spring cavity extending downward from the top surface into which is inserted a spring,
(3) a lower guide tube bore that extends through said stationary armature,
b) a movable armature located above said stationary armature and having:
(1) a top surface, a bottom surface, and a diameter that allows said movable armature to traverse longitudinally through said solenoid housing,
(2) an upper guide tube bore therethrough having a slightly larger diameter than that of the lower guide tube bore,
c) a non-magnetic paint guide tube having a lower section that is press-fitted into the lower guide tube bore on said stationary armature, with its end inserted into the siphon tube located within said spray can and an upper section that projects upward from said stationary armature and into the slightly larger diameter upper guide tube bore on said movable armature to function as a positioning guide for said movable armature,
d) an external, separable movable-armature activator comprised of an electromagnetic coil sized to fit over said solenoid housing, where when said activator is not connected to an a-c utility power receptacle, the paint pressure and said spring, located in said stationary armature, maintains said movable armature in the de-energized, upward position which allows the top surface of said movable armature to press against the lower end of said spray control valve and function as a series valve that is in a closed position, thus preventing said spray control valve form receiving paint and preventing said spray head from dispensing paint, conversely, when said linear-motion solenoid assembly is connected to the a-c utility power, said movable armature overcomes the paint pressure and spring bias and moves to the energized, downward position in which position paint flows to said spray control valve and said spry control valve can be activated by manually depressing said spray head to allow pressurized paint to flow through said paint guide tube and out of said spray head.

3. A utility-power operated, tamper-proof pressurized spray can comprising:
A. a pressurized spray can comprising:
a) an upper section having a housing opening that includes around its circumferential perimeter a first attachment seam,
b) a siphon tube uprightly located therein,
B. a non-magnetic solenoid housing comprising:
a) a top section that includes an upper protuberance having an interior and a spray head stem opening,
b) an open bottom section having at its perimeter edge a second attachment seam designed to interface with the first attachment seam on said can,
C. a spray control valve retaining structure having an upper surface and a lower surface, and a valve retaining cavity recessed into the upper surface of the structure and mating with the interior of the upper protuberance and further having a paint passage bore coaxial with and below the cavity recess in said spray control valve retaining structure,
D. a paint passage sealing means located on the lower surface of said valve retaining structure around the paint passage bore,
E. a spray control valve crimped into said upper protuberance, and further inserted and held within the valve retaining cavity on said spray control valve retaining structure,
F. a separable spray head having an upper surface and a downward, hollow stem that is inserted into said spray control valve,
G. a linear-motion solenoid assembly located within said non-magnetic housing and having:
a) a stationary armature comprising:
(1) a lower section that is positioned and rigidly attached near the lower perimeter edge of said housing by an attachment means,
(2) an integral upper section having a top surface and a smaller diameter that allows a space to exist between the upper section and said solenoid housing,
(3) a spring cavity extending downward from the top surface of said upper section into which is inserted a spring,
(4) a lower guide tube bore that extends through the bottom of the spring cavity and through the lower section of said stationary armature,
b) a movable armature located above said stationary armature and having:
(1) a top surface, and a bottom surface,
(2) a diameter substantially equal to the diameter of the upper section of said stationary armature,
(3) an upper guide tube bore therethrough having a slightly larger diameter than that of the lower guide tube bore,
c) a non-magnetic paint guide tube comprising:
(1) a lower section that is press-fitted into the lower guide tube bore on said stationary armature, with the lower section having an end that projects through said stationary armature and is inserted into the siphon tube located within said spray can,
(2) an upper section that projects upward form the top surface of said stationary armature and into the slightly larger diameter upper guide tube bore on said movable armature, where said paint guide tube also functions as a positioning guide for said movable armature,
d) an external, separable movable-armature activator comprised of an electromagnetic coil having a center attachment opening sized to fit over the diameter of said solenoid housing, where when said activator is not connected to an a-c utility power receptacle, paint pressure and said spring, located in said stationary armature, maintains said movable armature in the de-energized, upward position that prevents said spray control valve from receiving paint and preventing said spray head from dispensing paint, conversely, when said linear-motion solenoid assembly is connected to the a-c utility power said movable armature overcomes the spring bias and paint pressure and moves to the energized, downward position in which position paint flows to said spray control valve and said spray control valve can be activated by manually depressing said spray head to allow pressurized paint to flow out of said spray head.

4. The pressurized spray can as specified in claim 3 further wherein said paint passage sealing means comprises:

a) an o-ring channel centrally located on the lower surface of said valve retaining structure around the paint passage bore and, b) a resilient o-ring partially inserted and attached within said o-ring channel by an attachment means, whereupon when said movable armature is placed in its de-energized upward position, the o-ring seals against the paint passage bore to prevent paint flow through said spray control valve.

5. The pressurized spray can as specified in claim 3 wherein said means for rigidly attaching said stationary armature to said solenoid housing comprises:

a) a male crimp ring located around the perimeter of said housing above the second attachment seam, and b) a female crimp ring located around the perimeter of said stationary armature in alignment with said male crimp ring, where when said stationary armature is pressed into the housing bore on said pressurized spray can and said pair of crimp rings interface, said stationary armature is rigidly attached.

6. The pressurized spray can as specified in claim 3 further comprising a non-magnetic valve leaf configured in an L-shape with a vertical section and a horizontal section, where the vertical section is loosely coupled, by an attachment means, to a valve leaf attachment step located in a chord relationship on one side of said movable armature and the horizontal section is movably positioned in either an open position or a closed position, between said paint passage sealing means on said valve retaining structure and the top surface of said movable armature, where said movable armature is designed to be maintained in a normal, de-energized, upward position by said spring and paint pressure in which position, the top surface of said movable armature makes contact with said valve leaf, placing said valve leaf in its closed position against a valve sealing means, or in an energized, downward position in which position, the bottom surface of said movable armature makes contact with the top surface of said stationary armature, causing said leaf spring to move to its open position to allow paint to flow through the paint passage bore.

7. The pressurized spray can as specified in claim 3 wherein said stationary armature further comprises a paint flow channel that extends horizontally across the upper surface of said stationary armature from one side of the spring cavity to the edge of said stationary armature.

8. The pressurized spray can as specified in claim 7 wherein the lower section of said non-magnetic paint guide tube further having, within a distance confined by the length of the spring cavity a paint passage opening that allows a paint flow to exit and flow through the paint flow channel on said stationary armature and onto the paint passage bore.

9. The pressurized spray can as specified in claim 3 wherein said external, separable, movable-armature activator further comprises an electronic power circuit consisting of a full-wave bridge rectifier circuit having an input that is connected via an a-c power cord to an a-c utility power source and an output that supplies a pulsating d-c current that operates activator which then causes said movable armature to move to its energized, downward open position.

10. A utility-power operated, tamper-proof pressurized spray can comprising:

A. a pressurized spray can comprising:

a) an upper section having a housing opening that includes around its circumferential perimeter a first attachment seam, b) a lower section that attaches to the upper section by means of an attachment ring, c) a liquid siphon tube uprightly located therein, B. a non-magnetic solenoid housing comprising:

a) a top section that includes an upper protuberance having a spray had stem opening, b) an open bottom section having at its perimeter edge a second attachment seam designed to interface with the first attachment seam on said can, C. a spray control valve retaining structure having:

a) an upper surface and a lower surface, b) a valve retaining cavity recessed into the upper surface and that is centrally located under the upper protuberance, with the cavity having a substantially centered paint passage bore extending from the bottom of the cavity recess to the bottom of said spray control valve retaining structure, D. a paint passage sealing means located on the lower surface of said valve retaining structure around the paint passage bore, E. a spray control valve held within the upper protuberance by a valve crimp and further inserted into the valve retaining cavity and held therein by an attachment means, said valve having a paint passage channel that interfaces with the paint passage bore on said valve retaining structure, F. a separable spray head having an upper surface and a downward, hollow stem that is inserted into said spray control valve, G. a linear-motion solenoid assembly comprising:

a) a stationary armature having:

(1) a lower section having a bottom surface and a diameter that allows said stationary armature to tightly fit into said solenoid housing with the bottom surface positioned near the lower perimeter edge of said housing, (2) an attachment means for rigidly attaching said stationary armature to said solenoid housing, (3) an integral upper section having a top surface and a smaller diameter than that of the lower section, where the smaller diameter allows a space to exist between the upper section and said solenoid housing that magnetically decouples said movable armature to prevent the use of an external magnet to energize said solenoid assembly, (4) a spring cavity substantially centered and extending downward from the top surface of said upper section, (5) a spring inserted into said spring cavity, (6) a lower guide tube bore that extends through the bottom of the spring cavity and through the lower section of said stationary armature, (7) a paint flow channel that extends horizontally across the upper surface of said stationary armature from one side of the spring cavity to the edge of said stationary armature, b) a movable armature having:

(1) a top surface and a bottom surface, (2) a diameter substantially equal to the smaller diameter of the upper section of said stationary armature, (3) an upper guide tube bore therethrough having a slightly larger diameter than that of the lower guide tube bore on said stationary armature, (4) a valve leaf attachment step located in chord relationship on one side of said movable armature, and having a vertical side, and (5) a non-magnetic valve leaf configured in an L-shape with a vertical section and a horizontal section, where the vertical section is loosely coupled, by an attachment means, to the vertical side of the valve leaf attachment step and the horizontal section is movably positioned, in either an open position or a closed position, between the valve sealing means on the lower surface of said valve retaining structure and the top surface of said movable armature, where said movable armature is designed to be maintained in a normal, de-energized, upward position by said spring and paint pressure in which position, the top surface of said movable armature makes contact with said valve leaf, placing said valve leaf in its closed position, or in an energized, downward position in which position, the bottom surface of said movable armature makes contact with the top surface of said stationary armature, causing said leaf spring to move to its open position to allow paint to flow through the paint passage bore, c) a non-magnetic paint guide tube comprising:

(1) a lower section that is press-fitted into the lower guide tube bore on said stationary armature, with the lower section having a lower end that projects through the bottom surface of said stationary armature and is inserted into the siphon tube located within said spray can, the lower section further having, within a distance confined by the length of the spring cavity, a paint passage opening that allows a paint flow to exit and flow through the paint flow channel on said stationary armature, (2) an upper section that projects upward form the top surface of said stationary armature and into the slightly larger diameter upper guide tube bore on said movable armature, where said paint guide tube also functions as a guide for said movable armature, d) an external, separable, movable-armature activator comprising:

(1) an electromagnetic coil having a center attachment opening sized to fit over the diameter of said non-magnetic solenoid housing, a length that substantially encloses the length of said housing and a pair of coil input terminals, (2) a non-magnetic, outer coil casing that encloses said coil and is attached thereto by an attachment means, said casing having an opening positioned to allow the pair of coil input terminals to project therethrough, (3) a handle having a forward section that attaches, by an attachment means, to said outer coil casing and that includes a power circuit housing and a trigger pivot housing that houses a trigger structure that includes a lower mechanical finger trigger and an upper head spray lever that pivots about a trigger pivot and that interfaces with the upper surface of said spray head, (4) means for releasably attaching said movable-armature activator to said paint spray can, and (5) an electronic power circuit located within the power circuit housing that is comprised of an a-c power cord having a first end that has attached an a-c power connector that connects to an a-c utility power receptacle and a second end that is attached to the input of a full-wave rectifier, where the output of the full-wave rectifier is connected to the coil input terminals of said electromagnetic coil, where the use of the a-c utility power precludes the use of low-voltage batteries to operate said linear-motion solenoid assembly where when said linear-motion solenoid assembly is not energized by said movable-armature activator, the paint pressure and said spring, located in said stationary armature, maintain said movable armature in the de-energized, upward position in which position, said valve leaf and said paint passage sealing means function in combination as a closed valve that is in series with said spray control valve, where the closed combination valve prevents said spray control valve from receiving paint and prevents said spray head from dispensing paint, conversely, when said movable-armature activator is connected to an a-c power receptacle, a pulsating d-c current is produced by said full-wave rectifier that energizes said electromagnetic coil which then causes said movable armature to overcome the paint pressure and spring bias and move to the energized, downward position in which position the combination valve opens to allow said spray control valve to be activated when said spray head is depressed which then allows pressurized paint to flow through said paint passage bore and out of said spray head.

11. The pressurized spray can as specified in claim 10 wherein said paint passage bore sealing means comprises:

a) an o-ring channel centrally located on the lower surface of said valve retaining structure around the paint passage bore, and b) a resilient o-ring partially inserted and attached within said o-ring channel by an attachment means, whereupon when said movable armature is in its de-energized, upward position, the o-ring functions to seal against said valve leaf and seal the paint passage bore to prevent paint flow through said spray control valve.

12. The pressurized spray can as specified in claim 11 wherein said o-ring attachment means comprises an adhesive.

13. The pressurized spray can as specified in claim 10 wherein said means for attaching said spray control valve to the valve retaining cavity on said valve retaining structure comprises an adhesive.

14. The pressurized spray can as specified in claim 10 wherein said paint passage bore sealing means comprises:

a) a downward extending lip centrally fixed to the lower surface of said valve retaining structure around the paint passage bore, and b) a compliant pad attached to the upper surface of said valve leaf, whereupon when said movable armature is placed in its de-energized, upward position, said pressure ring contacts said compliant pad to seal and prevent paint flow through said spray control valve.

15. The pressurized spray can as specified in claim 10 wherein said paint passage bore sealing means comprises an expanded bore lip that is attached around the perimeter of the paint passage bore, where around said expanded bore lip is mounted a stretchable compliant ring having a paint passage bore and that functions as an o-ring, when said movable armature is placed in its de-energized, upward position, said compliant ring contacts the upper surface of said valve leaf to seal said paint passage bore and prevent paint flow through said spray control valve.

16. The pressurized spray can as specified in claim 10 wherein said means for rigidly attaching said stationary armature to said solenoid housing comprises:

a) a male crimp ring located around the perimeter of said housing above the second attachment seam, and b) a female crimp ring located around the perimeter of said stationary armature in alignment with said male crimp ring, where when said stationary armature is inserted into the open bottom section of said housing and said pair of crimp rings interface, said stationary armature is rigidly attached.

17. The pressurized spray can as specified in claim 10 wherein said valve leaf attachment means comprises:

a) a leaf pin bore located through the vertical section of said valve leaf, b) a slightly smaller step pin bore located on the valve leaf attachment step located on said movable armature, and c) a press-fit pin that is inserted through the leaf pin bore and tightly into the step pin bore to loosely couple said valve leaf to the valve leaf attachment step.

18. The pressurized spray can as specified in claim 10 wherein said valve leaf further comprises a pair of pivot indentations that are aligned horizontally with respect to the center of the leaf pin bore and extend inward form each side of its vertical section, where said pivots facilitate the pivoting action of said valve leaf form an energized position to a de-energized position and vice versa while limiting sideward movement and allowing precise alignment of said valve leaf and the paint passage sealing means.

19. The pressurized spray can as specified in claim 18 wherein said valve leaf further comprises a dimple that extends downward from its lower surface and concentrically aligned with said paint passage bore, where said dimple provides a means for allowing tiltable alignment of said valve leaf with said paint passage sealing means.

20. The pressurized spray can as specified in claim 10 wherein said means for releasably attaching said spray can comprises at least one spring latch having an upper end that is rigidly attached to the bottom of the forward section of said handle and a lower end having a gripping hook that attaches to an attachment ring on said spray can.

21. A utility-power operated, tamper-proof pressurized spray can comprising:

A. a pressurized spray can comprising:

a) an upper section having a protuberance that includes a spray-head insertion opening that interfaces with the upper end of a spray control valve located therein, where said valve has a lower end that attaches to the upper end of a paint siphon tube uprightly located therein, b) a lower section that attaches to the upper section by means of an attachment ring, B. a non-magnetic solenoid housing comprising:

a) a top section that includes an upper protuberance having a spray head stem opening, b) an open bottom section having at its perimeter edge an attachment seam sized to forceably interface with the attachment ring on said can, C. a spray control valve retaining structure having:

a) an upper surface and a lower surface, b) a valve retaining cavity recessed into the upper surface and that is centrally located under the upper protuberance, with the cavity having a substantially centered paint passage bore extending form the bottom of the recess to the bottom of said spray control valve retaining structure, D. a paint passage sealing means located on the lower surface of said valve retaining structure adjacent the paint passage bore, E. a spray control valve held within the upper protuberance by a valve crimp and further inserted into the valve retaining cavity and held therein by an attachment means, said valve having a paint passage channel that interfaces with the paint passage bore on said valve retaining structure, F. a separable spray head having an upper surface and a downward, hollow stem that is inserted into said spray control valve, G. a linear-motion solenoid assembly comprising:

a) a stationary armature having:

(1) a lower section having a bottom surface and a diameter that allows said stationary armature to tightly fit into said solenoid housing with the bottom surface positioned near the lower perimeter edge of said housing, (2) an attachment means for rigidly attaching said stationary armature to said solenoid housing, (3) an integral upper section having a top surface and a smaller diameter than that of the lower section, where the smaller diameter allows a space to exist between the upper section and said solenoid housing that magnetically decouples said movable armature to prevent the use of an external magnet to energize said solenoid assembly, (4) a spring cavity substantially centered and extending downward from the top surface of said upper section, (5) a spring inserted into said spring cavity, (6) a lower guide tube bore that extends through the bottom of the spring cavity and through the lower section of said stationary armature, (7) a paint flow channel that extends horizontally across the top surface of said stationary armature from one side of the spring cavity to the edge of said stationary armature, b) a movable armature having:

(1) a top surface and a bottom surface (2) a diameter substantially equal to the diameter of the upper section of said stationary armature, (3) an upper guide tube bore therethrough having a slightly larger diameter that that of the lower guide tube bore on said stationary armature, (4) a valve leaf attachment step located in chord relationship on one side of said movable armature, (5) a non-magnetic valve leaf configured in an L-shape with a vertical section and a horizontal section, where the vertical section is loosely coupled, by an attachment means, to the valve leaf attachment step and the horizontal section is movably positioned, in either an open position or a closed position, between the valve sealing means on the lower surface of said valve retaining structure and the top surface of said movable armature, where said movable armature is designed to be maintained in a normal, de-energized, upward position by said spring and paint pressure in which position, the top surface of said movable armature makes contact with said valve leaf, placing said valve leaf in its closed position, or in an energized, downward position in which position, the bottom surface of said movable armature makes contact with the top surface of said stationary armature, causing said leaf spring to move to its open position to allow paint to flow through the paint passage bore, c) a non-magnetic paint guide tube comprising:

(1) a lower section that is press-fitted into the lower guide tube bore on said stationary armature, with the lower section having a lower end that projects through the bottom surface of said stationary armature and that is sized to be inserted into the spray-head insertion opening located on the upper section of said spray can, the lower section further having, within a distance confined by the length of the spring cavity, a paint passage opening that allows a paint flow to exit and flow through the paint flow channel on said stationary armature and into the paint passage bore, (2) an upper section that projects upward from the top surface of said stationary armature and into the slightly larger diameter upper guide tube bore on said movable armature, where said paint guide tube also functions as a positioning guide for said movable armature, d) an external, separable, movable-armature activator comprising:

(1) an electromagnetic coil having a center attachment opening sized to fit over the diameter of said solenoid housing, a length that encloses the entire length of said housing and a pair of coil input terminals, (2) a non-magnetic, outer coil casing that encloses said coil and is attached thereto by an attachment means, said casing having an opening positioned to allow the pair of coil input terminals to project therethrough, (3) a handle having a forward section that attaches, by an attachment means, to said outer coil casing and that includes a power circuit housing and a trigger pivot housing that houses a mechanical trigger structure that includes a lower finger trigger and an upper head spray lever that pivots about a trigger pivot and that interfaces with the upper surface of said spray head, (4) means for releasably attaching said movable-armature activator to said paint spray can, and (5) an electronic power circuit located within the power circuit housing that is comprised of an a-c power cord having a first end that connects to an a-c utility power receptacle and a second end that is attached to the input of a full-wave rectifier, where the output of the full-wave rectifier is connected to the coil input terminals of said electromagnetic coil, where when said linear-motion solenoid assembly is not energized by said movable-armature activator, said spring, located in said stationary armature, maintains said movable armature in the de-energized, upward position that prevents said spray control valve from receiving paint and preventing said spray head from operating, conversely, when said movable-armature activator is connected to an a-c power receptacle, a d-c current is produced by said full-wave rectifier that energizes said electromagnetic coil which then causes said movable armature to overcome the spring bias and paint pressure and move to the energized, downward position in which position, said spray control valve can be activated by said spray head to allow pressurized paint to flow through said paint guide tube and out of said spray head.

22. The pressurized spray can as specified in claim 21 further comprising an adhesive ring located around the internal intersection of the attachment seam on said solenoid housing and the attachment ring on said spray can.

* * * * *